United States Patent [19]

Stritzl et al.

[11] Patent Number: 4,878,687

[45] Date of Patent: Nov. 7, 1989

[54] SKIBREMSE

[75] Inventors: Karl Stritzl, Vienna; Franz Luschnig, Traiskirchen; Andreas Riegler, Vienna; Hubert Wurthner, Hainburg/Donau; Henry Freisinger, Vienna, all of Austria

[73] Assignee: TMC Corporation, Switzerland

[21] Appl. No.: 154,346

[22] PCT Filed: May 18, 1987

[86] PCT No.: PCT/EP87/00262

§ 371 Date: Jan. 6, 1988

§ 102(e) Date: Jan. 6, 1988

[87] PCT Pub. No.: WO87/07515

PCT Pub. Date: Dec. 17, 1987

[30] Foreign Application Priority Data

Jun. 3, 1986 [AT] Austria ..... 1483/86

[51] Int. Cl.[4] ..... A63C 7/10

[52] U.S. Cl. ..... 280/605

[58] Field of Search ..... 280/604, 605

[56] References Cited

U.S. PATENT DOCUMENTS

| | | | |
|---|---|---|---|
| 4,124,223 | 11/1978 | Kubelka | 280/605 |
| 4,383,699 | 5/1983 | Beyl | 280/605 |
| 4,403,788 | 9/1983 | Bernard et al. | 280/605 |
| 4,463,967 | 8/1984 | Klubitschiko | 280/605 |
| 4,537,418 | 8/1985 | Knabel et al. | 280/605 |

FOREIGN PATENT DOCUMENTS

| | | | |
|---|---|---|---|
| 360892 | 2/1981 | Austria . | |
| 372286 | 9/1983 | Austria . | |
| 374114 | 3/1984 | Austria . | |
| 45698 | 2/1982 | European Pat. Off. . | |
| 0045698 | 2/1982 | European Pat. Off. . | |
| 2554110 | 6/1977 | Fed. Rep. of Germany . | |
| 3136079 | 3/1983 | Fed. Rep. of Germany | 280/605 |
| 2339415 | 8/1977 | France . | |
| 2508325 | 12/1982 | France | 280/605 |
| 2512682 | 3/1983 | France . | |
| 2516392 | 5/1983 | France . | |

*Primary Examiner*—Charles A. Marmor
*Assistant Examiner*—Tamara L. Finlay
*Attorney, Agent, or Firm*—Finnegan, Henderson, Farabow, Garrett & Dunnerd

[57] ABSTRACT

The invention concerns a ski brake consisting of a two-part wire bail of which the individual bail pieces are bent or angled off several times, comprising also two wire brake-arms, said ski brake pivoting against the force of at least one erecting spring from a braking position into a ready position wherein the free ends of the two wire brake-arms are pivoted toward the longitudinal ski axis, i.e. are retracted above the top side of the ski or pivoted-in. The ski brake includes an actuation pedal which is depressed by a ski boot and of which the lower side forms at least in part a guide for segments of both bail pieces, the two mutually facing segments of the wire brake-arms supporting a connecting spring. In the invention, the connecting spring (7) comprises a cross-rod (7*c*) whereby it rests on or in a guide path (2*e*) of the base plate (2). In the braking position, the connecting spring (7*c*) rests at least in part against the front limit wall (4*h*) of a passage (4*b*) of the actuation pedal (4). Two leg-springs are provided as the erecting spring (8). The connecting spring may also consist of an essentially U-shaped plastic spring (as seen in front view).

8 Claims, 5 Drawing Sheets

SKIBREMSE

BACKGROUND OF THE INVENTION

The invention relates to a ski brake having a bail and two wire brake-arms.

A ski brake of this type is illustratively and approximately described in Austrian Pat. No. 374,114. While this document per se discloses a brake system consisting of several integral and repeatedly bent single bails of spring wire, the possibility of making the brake system into a two-part bail, of which the individual parts also are per se bent several times, also is disclosed therein. An approximtely cross-sectionally V-shaped recess is provided, to pivot and retract the two wire brake-arms, at the actuation pedal, which extends in the longitudinal direction of the brake system and of which the height corresponds approximtely to the wire diameter. While thereby the two wire brake arms are retracted within the ski contour in the last phase of the actuation-pedal depression, the excursion of the in-pivoting motion on the other hand is restricted by the wire size. As a result, the application of the known ski brake is restricted to a system which is directly on one ski.

SUMMARY OF THE INVENTION

The object of the invention is to further develop a ski brake of the initially cited kind so that the brake can pivot-in farther and accordingly shall be fully effective when used together with a pivot or a touring plate.

This and other objects are achieved by providing a ski brake wherein two wire brake-arms are allowed a large mutual pivoting motion because their individual and facing segments hold a connecting spring. Because the individual wire brake-arms pivot in or out against the force of this connecting spring which is apart from the erection spring, the designer is offered a larger selection regarding the sizing of the spring force to swing up the brake system and to retract it than if the retraction had to take place against the spring force stored in the wire material itself, as is the case in the single spring wire. Because the connecting spring rests against the front limit wall of a passage of the actuation pedal, the pivoting parts of the ski brake become additionally stable. This stability is further enhanced in that two erection springs are used which keep the connecting spring in position at the base plate. As a result, the advantage of simple assembly of the brake system is obtained.

Per se, the step of so linking a single-part spring-wire bail to an actuation pedal that the cross rod of the spring-wire bail at least passes through one guide of the actuation pedal is known from Austrian Pat. No. 372,286. However, in this known solution, the retraction of the individual wire brake-arms is performed by a linkage system consisting of bearing brackets pivotably mounted on the base plate and wherein, as considered from the ready position of the brake system, wire segments transverse to the ski longitudinal direction are resting which simultaneously form the pivot spindle of the brake system. To this extent this known solution is remote from the one already considered.

Again the step is known to mount the connecting spring to mutually facing wire brake-arms. One of the earliest of such solutions is described in Austrial Pat. No. 360,892. This known solution employs a wedge rising from the base plate and spreading apart the wire-brake arms, when the brake system is rotated down, against the force of the connecting spring, so that the two brake spindles above the ski topside and within the ski come to rest.

A similar solution is disclosed in the European Patent Publication No. B 0 045 698. However in this known solution the connecting spring of the two wire brake-arms is a leaf spring rigidly joined to the actuation pedal. As a result, upon every depression and upward swing of the brake system, the leaf spring is additionally stressed by torsion. In this design the erection member is tensile and forms such an angle with the leaf spring that it bends the latter. No features of the ski brake of the present invention can be inferred from this known solution.

German Offenlegungsschrift No. 31 36 079 also discloses mounting a connecting spring to mutually facing segments of the individual wire-brake arms, and this known step therefore being stated as known. However the in-pivoting motion of the two wire brake-arms is performed in this known ski brake in that upon depressing the actuation pedal, a stop member mounted to the base plate loads the connection spring in the ski longitudinal direction, whereby the brake system is made to straighten. Because such a control is also known from German Offenlegungsschrift No. 25 54 110, and because in the solution of the present invention the control of the two wire brake-arms is implemented by the stated design and without employment of a stop or the like, no further disclosure can be inferred from this known solution that would affect the invention.

An especially simple and effective assembly and design of the cross rod is achieved by the features of the subject invention.

The features of the subject invention relate to securing the cross rod by the erection spring.

The features of the subject invention assure special compactness of the ski brake.

Diverse approaches can be used to support the connection spring on the actuation pedal. However it was found to be especially advantageous that the support be effected by the design of the passage defined by the features of the subject invention. Advantageously free motion of the legs of the connection spring is also obtained thereby without affecting the stability of the entire brake system. The features of the subject invention secure limited displaceability in the longitudinal ski direction for the individual wire brake-arms. In this manner the wire brake-arms themselves can assume the desired relative position to the base plate in an unhampered manner and without being stressed in the different positions of the brake system.

When making the connection spring from a spring-wire, problems may arise concerning the dimensions of particular design features of the connecting spring in that high stability is required of the loop in its longitudinal direction, whereas the coils of the connection spring besides the segments holding the individual wire brake-arms must easily deform for the sake of their pivoting motion. This problem too is solved by the further steps of the invention.

This problem is solved most of all by the features of the subject invention. Because the connection spring is a plastic spring, its supporting cross rod can be dimensioned independently of those segments of this spring which are linked to the mutually facing segments of the two wire brake-arms. By designing the plastic spring in such a manner that, when seen in front view, it is essentially U-shaped, the spring system performing the retraction of the two wire brake-arms again can be more easily adapted to the particular requirements than in the case of a connecting spring made of spring-wire.

A design according to the features of the subject invention allows an especially simple and appropriate structure of the connection-spring fastening.

The features of the subject invention not only provide greater freedom in determining the range of action of the legs of the two leg-springs acting as the erecting springs, but also enlarge the resting area of the plastic spring at the holder on the side of the ski.

The features of the subject invention also allow determining the desired brake position of the ski brake regardless of the length of the plastic spring, whereby plastic springs of the same size can be manufactured for different kinds of ski brakes, for instance for adults and children.

BRIEF DESCRIPTION OF THE DRAWINGS

Further advantages and details of the invention shall now be discussed more closely in relation to the drawing showing two embodiments.

DETAILED DESCRIPTION OF THE PREFERRED EMBODIMENT

Figure 1:
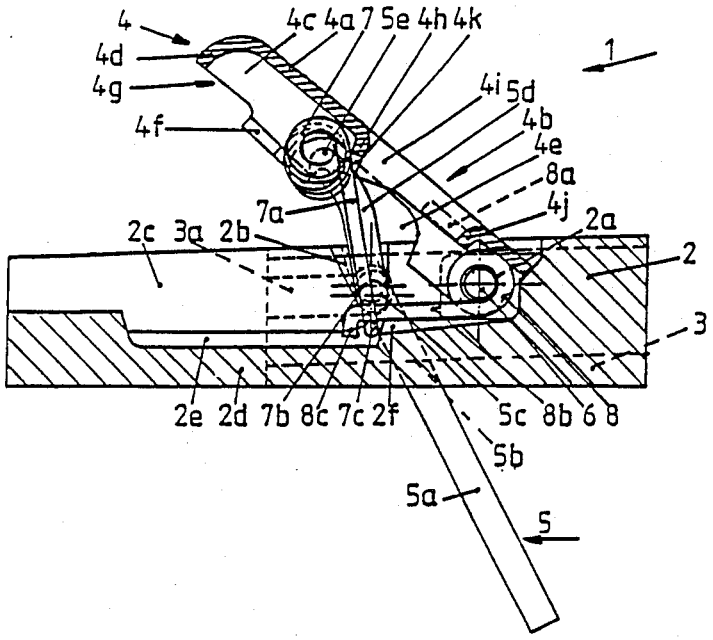
FIGS. 1 and 2 show in associated views a first embodiment of a ski brake of the invention in the braking position, FIG. 1 being a longitudinal section view along line I—I of FIG. 2 and FIG. 2 being a topview relating to FIG. 1.

FIGS. 1 through 6 show a ski brake denoted in its entirety by 1, of which the base plate 2 illustratively is integral with a pivotable sole plate or a touring plate, or else is mounted in an arbitrary manner on a ski, comprising at its one end bearings 2*a* for a pivot spindle 6. Additional bearings 2*b* are mounted a distance from the pivot spindle 6 on the base plate 2 and receive in their segments wire brake-arms 5 which shall be further discussed below. The bearings 2*b* for the wire brake-arms 5 flare upward and are open at the top. Illustratively, they are closed by symmetric U-shaped rails 3, and (as seen from front or rear) comprise elongated slots 3*a*, these rails 3 being connected in arbitrary manner to the base plate 2, illustrtively by screws or rivets. Centrally in its width, the base plate 2 comprises an approximately rectangular clearance 2*c* for an actuation pedal 4 hinging on the pivot spindle 6. Also, a guide path 2*e* extending in the longitudinal direction of the clearance 2*c* is provided at the bottom 2*d* of that clearance, which also comprises a longitudinal groove 2*f*.

The actuation pedal 4 is approximtely rectangular and includes an approximately square passage 4*b* in its upper surface designed as a stepping surface 4*a*, this passage 4*b* being symmetrical to the longitudinal axis of this stepping surface 4*a* and a slight distance from the pivot spindle 6. Side walls 4*c* and a front wall 4*d* of the actuation pedal 4 are bent at right angles toward the ski upper side. The side walls 4*c* are provided with elongated, rounded clearances 4*e* for the wire brake-arms 5. At the pedal segment away from the pivot spindle 6, the side walls 4*c* are provided with tabs 4*f* bent off toward the longitudinal axis of the ski brake 1. The passage 4*b* in the actuation pedal 4 is equipped with limit walls denoted as 4*h* for the front one, by 4*i* for the lateral ones and by 4*j* for the rear one. The front limit wall 4*h* comprises a clearance 4*k*. Snow that may have accumulated can be forced out through the passage 4*b*. By means of the stepping plate 4*a*, the side walls 4*c*, the front wall 4*d*, the tabs 4*f* and the front limit wall 4*h* of the passage 4*b*, the front zone of the actuation pedal 4 forms a guide 4*g* for the segments of the wire brake-arms 5 which shall be discussed comprehensively below.

Figure 2:
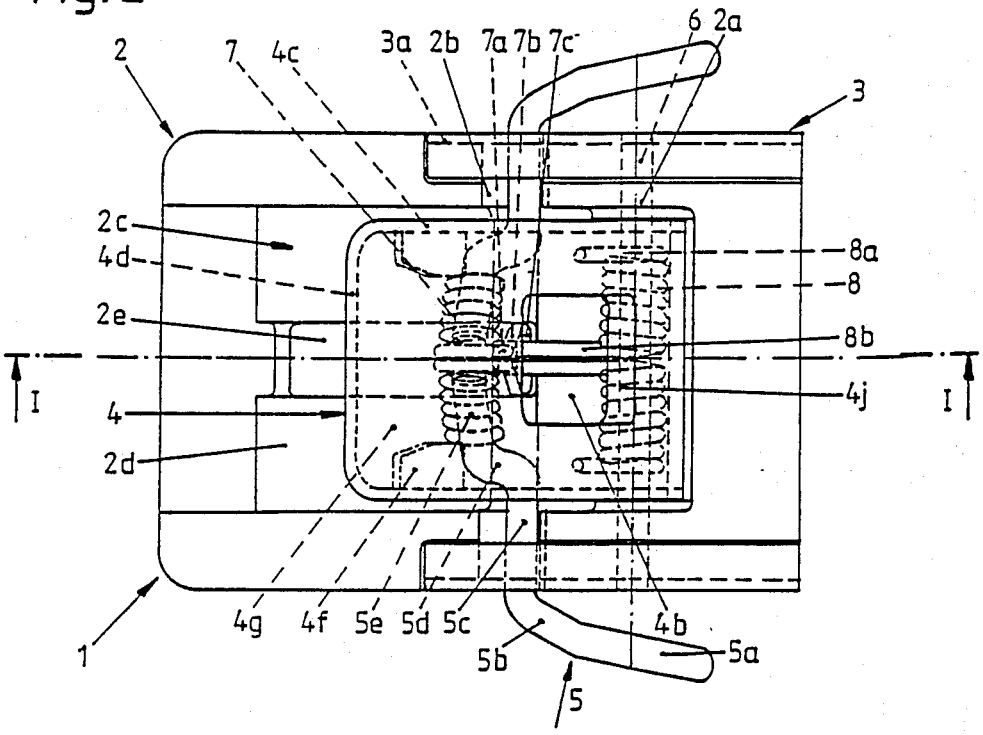
Figure 3:
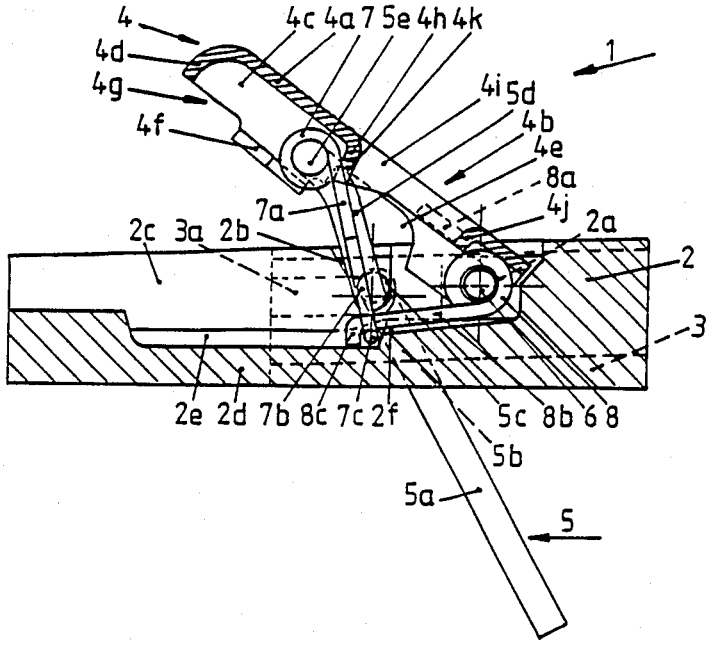
FIGS. 3 and 4 are views similar to FIGS. 1 and 2 respectively, except that the connection spring is prestressed and that the two wire brake-arms are spread apart.
Figure 4:
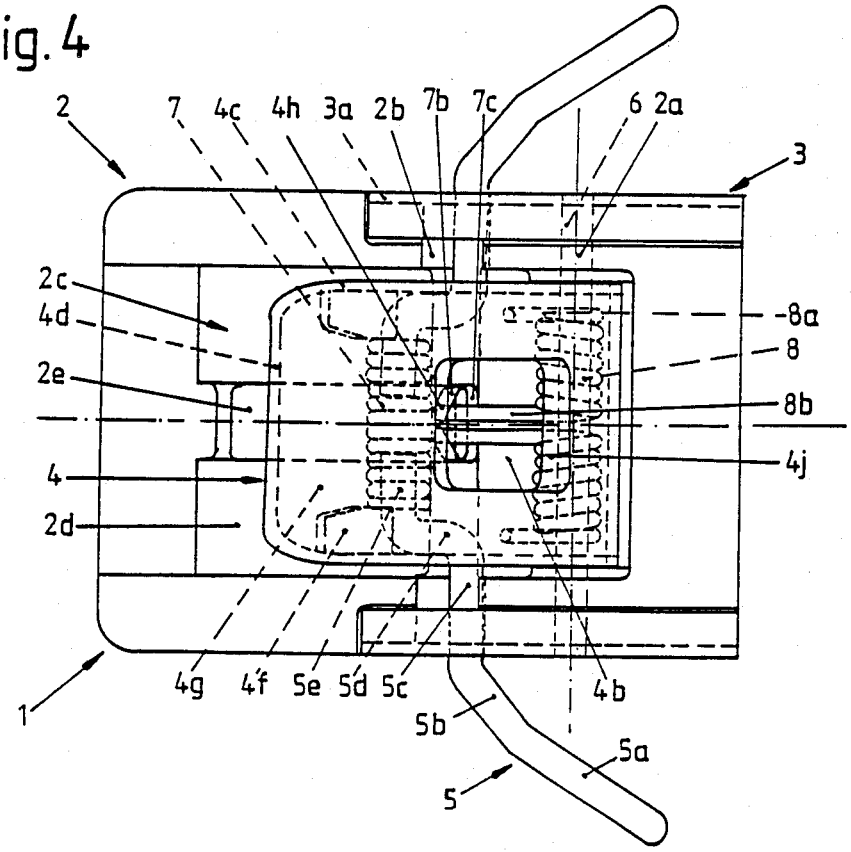
Figure 5:
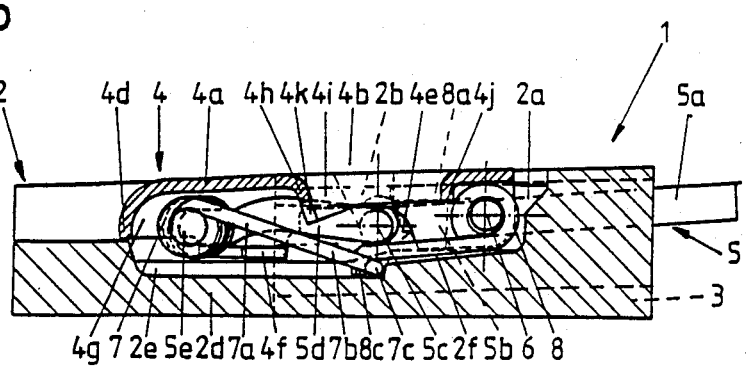
FIGS. 5 and 6 are also similar to FIGS. 1 and 2 respectively, for the ready position of the brake system.
Figure 6:
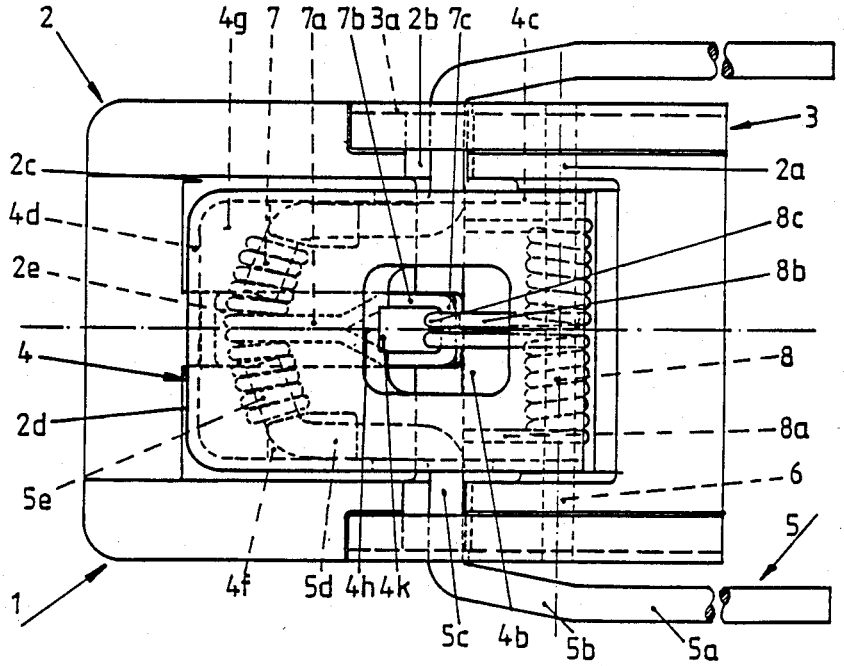

The wire brake-arms 5 consist of spring wire bent several times, and, as shown in particular by FIGS. 2, 4 and 6, they are symmetrical. As shown in FIG. 6, segments 5*a* of the wire brake-arms 5 are nearly parallel to the longitudinal axis of the ski brake 1 when seen in topview. These segments 5*a* illustratively may be provided with a plastic casting (not shown) and hereafter are called brake spikes. Segments 5*b* of the wire brake-arms 5 join the brake spikes 5*a* at an acute angle to the longitudinal axis of the ski brake 1. Further cross-segments 5*c* acting as pivot spindles for the individual wire brake-arms 5 join the segments 5*b*. the cross segments 5*c* of the wire brake-arms 5 are pivotably supported in the bearings 2*b* of the base plate 2. They are joined by further wire segments 5*d* extending forward and parallel to the longitudinal axis of the ski brake 1, passing inside the actuation pedal 4 and held in place by the tabs 4*f*. Further wire brake-arms 5*e* each subtend an obtuse angle with the longitudinal axis of the ski brake 1. They support a connection spring 7 having legs 7*a* of which the ends form a loop 7*b*. A part of the loop 7*b* shaped as a cross-rod 7*c* passes the guide path 2*e* of the base plate 2.

Leg springs acting as the erecting springs 8 are mounted around the pivot spindle 6, their legs 8*a* adjacent to the side walls 4*c* of the actuation pedal 4 loading this pedal in the direction of the active braking position of the ski brake 1, whereas the legs 8*b* of the erecting springs 8 adjacent to the longitudinal axis of the ski brake 1 depress the cross rod 7*c*, at least one hook segment 8*c* of the legs 8*b* overlapping the cross rod 7*c*.

When the ski brake 1 is in the active position, the connecting spring 7 at least in part rests against the front limit wall 4*h* of the passage 4*b*, the actuation pedal 4 being simultaneous forced up by the leg spring 8. A slight flexure is thereby exerted on the connecting spring 7 and the brake spikes 5*a* extend at a slight distance from the side surfaces of the ski brake 1, i.e. to the omitted ski (FIG. 2).

If the actuation pedal 4 is depressed, then it will be pivoted downward against the force of the spiral spring 8, the oblique segments 5*e* of the wire brake-arms 5 moving forward in the guide 4*g* of the actuation pedal and the connecting spring 7 straightening out. In the process the brake spikes 5*a* of the wire brake-arms 5 pivot to the outside into a position far from the side surfaces of the ski brake 1 (FIG. 4). As the actuation pedal 4 is depressed further, the oblique segments 5*e* of the wire brake-arms 5 move further forward in the guide 4*g*, whereby the cross rod 7*c* of the connecting spring 7 is strongly bent. As a result, the wire brake-arms 5*a* are moved into their retracted positions closest to the longitudinal axis of the ski brake 1 (FIG. 6).

If now the boot is freed due to deliberate or accidental release from the ski binding, then the brake spikes 5*a* perform an outward motion simultaneously with the rotation from the ready position into the braking position, and thereupon they move inward again toward the ski. As a result, damage to the side surfaces of the ski (here omitted) is avoided, and on the other hand hampering of the braking by the pivoting sole plate is excluded in the use of the ski brake with plate binding.

FIGS. 7 through 10 show a ski brake denoted in its entirety by 10 and of which the base plate 20 illustratively is of one piece with a pivoting sole or a touring plate, or is mounted in arbitrary manner on a ski, one end of this base plate comprising bearings 20*a* for a pivot spindle 60. Additional bearings 20*b* are mounted on the base plate 20 a distance from the pivot spindle 60 and received segments, to be further described below, of wire brake-arms 50. The bearings 20*b* for the wire brake arms 50 flare upward and are open at the top. Illustratively they are enclosed with U-shaped rails 30 comprising elongated slots 30*a*, and are, (as seen from front or rear) symmetric to the longitudinal axis of the ski brake, and which are connected in arbitrary manner, for instance by screws or rivets, to the base plate 20. Centrally in its width, the base plate 20 comprises an approximately rectangular clearance 20*c* for an actuation pedal 40 hinging on the pivot spindle 60, this clearance 20*c* being bounded by a bottom 20*d*.

The actuation pedal 40 is approximately rectangular and comprises in its upper surface, designed as a stepping surface 40*a*, a passage 40*b* symmetrical to its longitudinal axis and a slight distance from the pivot spindle 60. Side walls 40*c* and a front wall 40*d* of the actuation pedal 40 are bent toward the ski surface. The side walls 40*c* are provided with elongated, rounded clearances 40*e* for the wire brake-arms 50. The side walls 40*c* comprise tabs 40*f* bent toward the longitudinal axis in the pedal segment away from the pivot spindle 60. The passage 40*b* in the actuation pedal 40 is equipped with limit walls, the front one being denoted by 40*h*, the lateral ones by 40*i* and the rear one by 40*j*. Any accumulating snow can be forced out through the passage 40*b*. The front segment of the actuation pedal 40 forms a guide 40*g* bounded by the stepping plate 40*a*, the side walls 40*c*, the front wall 40*d*, the tabs 40*f* and the limit walls 40*h* of the passage 40*b* for segments to be more comprehensively described below of the wire brake-arms 50.

Figure 7:
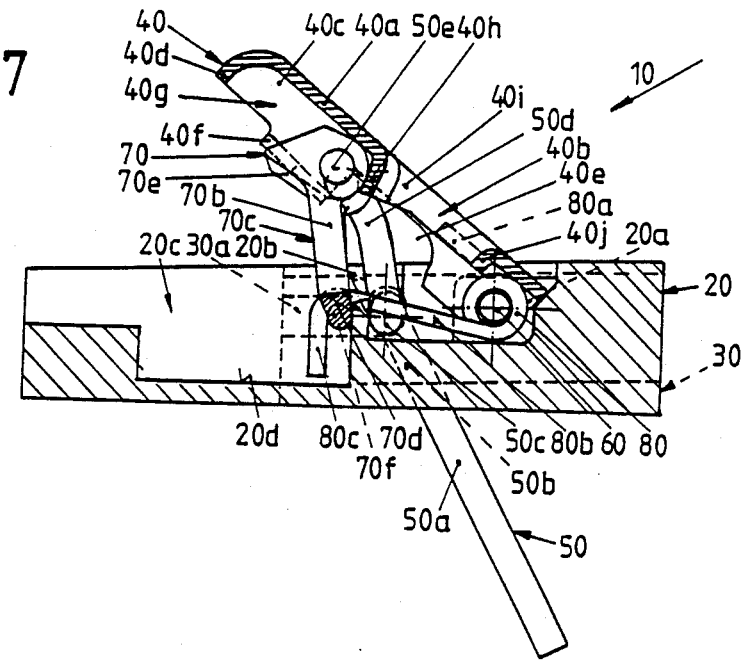
FIGS. 7 and 8 are associated views of a second embodiment of the ski brake of the invention in the braking position, FIG. 7 being a longitudinal section view along line VII—VII of FIG. 8, and FIG. 8 being a topview relating to FIG. 7.
Figure 8:
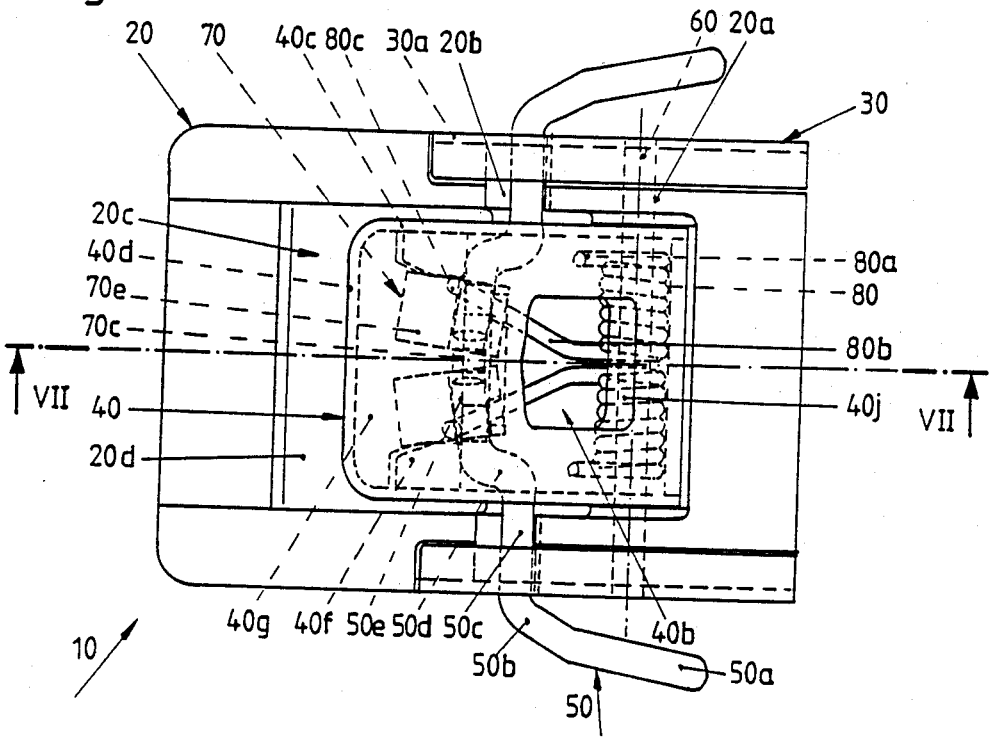
Figure 9:
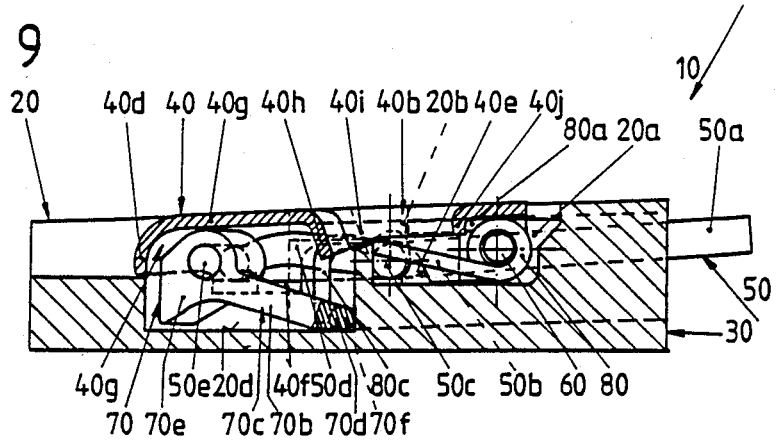
FIGS. 9 and 10 are similar to FIGS. 7 and 8 respectively, for the illustrating the ready position of the braking system.
Figure 10:
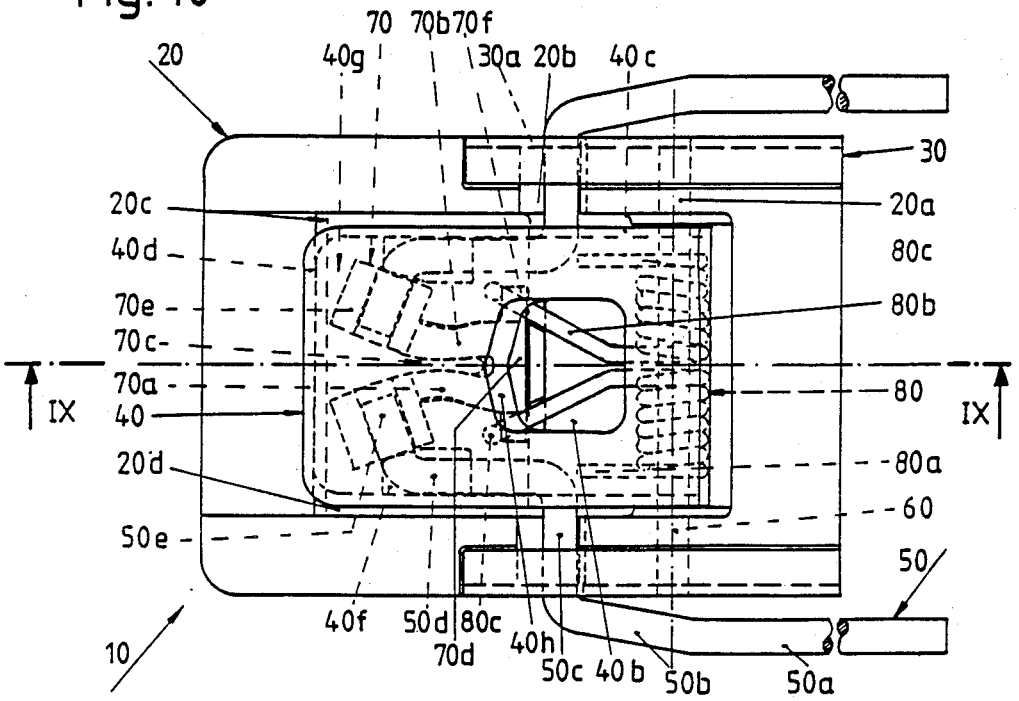

The wire brake-arms 50 consist of a spring wire bent several times and, symmetrical, as shown in particular in FIGS. 8 and 10. FIG. 10 shows segments 50*a* of the wire brake-arms 50 being approximately parallel to the longitudinal axis of the ski brake 10. Illustratively the wire segments 50*a* can be equipped with a plastic attachment added by spraying or injection, and omitted here, and hereafter they are called brake spikes. The brake spikes 50*a* are joined at an acute angle to the longitudinal ski brake axis by segments 50*b* of the wire brake-arms 50. The segments 50*b* are joined to cross-rods 50*c* acting as the pivot spindles for the individual wire brake-arms 50. The cross rods 50*c* of the wire brake-arms 50 are pivotably supported in the bearings 20*b* of the base plate 20. The cross rods 50*c* are joined by further wire segments 50*d* extending forward and parallel to the longitudinal axis of the ski brake 10, inside the actuation pedal 40, and held by the tabs 40*f*. Further brake-arm segments 50*e* extend each at an obtuse angle to the longitudinal axis of the ski brake 10. The brake-arm segments 50*e* support a connecting spring 70 equipped with a guide 70*a* which, as shown in FIG. 7, extends approximately toward the ski upper side in the active position of the ski brake 10. As shown in particular in FIG. 10, the connecting spring 70 is approximtely U-shaped, the two end zones of the U being linked to the mutually facing brake-arm segments 50*e*. The free end zones of the U-shaped connection spring 70 linked to the brake-arm segments 50*e* each comprise a neck 70*e* pointing away from the central longitudinal axis.

The guide 70*a* of the connecting spring 70 consists of a leg 70*b* and a crossbar 70*d* extended by lateral extensions 70*f*.

The leg-springs acting as the erecting springs 80 are mounted around the pivot spindle 60, their legs 80*a* adjacent to the side walls 40*b* of the actuation pedal 40 loading the actuation pedal 40 toward the active braking position of the ski brake 10, whereas the legs 80*b* of the erecting springs 80 adjacent to the longitudinal axis of the ski brake 10 depress the cross rod 70*d*. At least one hook segment 80*c* of a leg 80*b* encloses the cross rod 70*d*. This overlap can be central, or, as shown, by means of two hook segments 80*c* of both legs 80*b* at extensions 70*f* of the cross rod 70*d*.

In the active braking position of the ski brake 10, the connecting spring 70 rests at least in part against the front limit walls 40*h* of the passage 40*b*, the actuation pedal 40 being simultaneously forced up by the leg-spring 80. As a result the necks 70*e* of the connecting spring subtend a slight angle relative to a conceptual line transverse to the ski longitudinal axis, and the brake spikes 50*a* extend a slight distance from the side surfaces of the ski.

All the sequences of motion that take place when the actuation pedal is depressed are similar to those of the ski brake described in the first embodiment and accordingly shall not be shown or described in special detail.

In the first phase of depressing the actuation pedal 40, the necks 70*e* of the connecting spring 70 initially assume a position essentially transverse to the ski longitudinal axis, whereby the brake spikes 50*a*, as shown and described in the first embodiment, pivot outward. As the actuation pedal 40 is depressed further, the oblique segments 50*e* of the wire brake-arms 50 move farther to the front in the guide 40*g*, so that the cross rod 70*d* of the connecting spring 70 rests on the rear end of the clearance 20*c*, whereby the necks of 70*e* of the connecting spring 70 subtend a larger angle relative to a conceptual line transverse to the ski longitudinal axis than in the case of the braking position of the ski brake 10. As a result, the wire brake-arms 50*a* are moved into their retracted position, which is nearest the brake longitudinal axis (FIG. 10).

If now by deliberate or accidental release the boot is freed from the binding, then during the pivoting motion from the ready position into the active braking position, the brake spikes 50 will simultaneously move outward and then inward again toward the ski. As a result damage to the herein omitted ski is prevented. If the ski brake of the invention is used together with a plate link, hampering of braking by the pivotable sole plate also will be excluded.

Obviously the invention is not restricted to the illustrative embodiments shown. Rather, deviations are possible without thereby transcending the scope of the invention. Illustratively the legs of the connecting spring also may be special metal or plastic components, or the connecting spring may simultaneously be the erecting spring. Further, the cross rod of the connecting spring may be kept in place by a holder means separate from the erecting springs.

In the second illustrative embodiment, the leg or a hook segment of it also may engage a clearance of the cross rod and be mounted to this rod.

We claim:

1. A ski brake (1, 10) comprising:

a bail including first and second brake-arms (5, 50);

an erecting spring (8, 80) positioned to urge said ski brake (1, 10) into a braking position in which said first and second brake-arms (5, 50) are located next to side surfaces of a ski and project below said ski;

an actuation pedal (4, 40), the depression of which causes said ski brake to be positioned in a ready position in which said first and second brake arms (5, 50) are pivoted toward a longitudinal axis of said ski so that said first and second brake-arms (5, 50) do not extend below said ski; and a connecting spring (7, 70) including a cross rod (*7c, 70c*) supported by said first and second brake arms (5, 50) and positioned in a guide path (*2e, 20e*) of a base plate (2, 20) and against a front limit wall (*4h, 40h*) of a longitudinal passage (*4b, 40b*) of said actuation pedal (4, 40);

wherein said erecting spring (8, 80) comprises first and second legs (*8a, 80a; 8b, 80b*), said first leg (*8a, 80a*) biasing said actuation pedal (4, 40) toward said braking position and said second leg (*8b, 80b*) biasing said connecting spring (7, 70) toward said braking position.

2. A ski brake as defined in claim 1, wherein said connecting spring (7, 70) comprises a loop (*7b, 70b*) including said cross rod (*7c, 70c*) at a central longitudinal segment of said loop facing said base plate, and wherein at least one of said first and second legs (*8a, 8b, 80a, 80b*) overlap said cross rod (*7c, 70c*) of said connecting spring.

3. A ski brake as defined in claim 2, wherein said base plate comprises first and second upward-flaring bearings (*2b, 20b*) and first and second rails (3, 30) provided with first and second slots (*3a, 30a*) for displaceably supporting said bail in the longitudinal direction of said ski.

4. A ski brake as defined in claim 3, wherein said connecting spring (7, 70) comprises an essentially U-shaped plastic spring.

5. A ski brake as defined in claim 4, wherein at least said second leg (*8b, 80b*) engages said connecting spring (7, 70).

6. A ski brake as defined in claim 1, wherein said first leg (*8a, 80a*) biases said actuation pedal (4, 40) adjacent its side walls (*4c, 40c*).

7. A ski brake as defined in claim 1, wherein said second leg (*8b, 80b*) further comprises extensions (*70f*) externally overlapping said cross rod (*7c, 70c*).

8. A ski brake as defined in claim 1, further comprising a first and second neck (*70e*) provided at outer surfaces of said connecting spring, said first and second necks and said front limit wall (*4h, 40h*) comprising a stop for determining an angular setting of said ski brake when said ski brake is in its braking position.

* * * * *